US010850142B2

(12) United States Patent
Emonin

(10) Patent No.: US 10,850,142 B2
(45) Date of Patent: Dec. 1, 2020

(54) FULL BODY CLIMBING HARNESS

(71) Applicant: ZEDEL, Crolles (FR)

(72) Inventor: Simon Emonin, Grenoble (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 15/827,687

(22) Filed: Nov. 30, 2017

(65) Prior Publication Data

US 2018/0147427 A1 May 31, 2018

(30) Foreign Application Priority Data

Nov. 30, 2016 (FR) ..... 16 61750

(51) Int. Cl.
*A62B 35/00* (2006.01)
*A47D 13/08* (2006.01)

(52) U.S. Cl.
CPC ..... *A62B 35/0018* (2013.01); *A47D 13/086* (2013.01)

(58) Field of Classification Search
CPC ..... A62B 35/0018; A62B 35/0006; A62B 35/0012; A62B 35/0025; A47D 13/08
See application file for complete search history.

(56) References Cited

U.S. PATENT DOCUMENTS 1,939,062 A * 12/1933 Knight ..... A62B 35/00 24/312
2,108,716 A * 2/1938 Kuhlemann ..... B64D 17/30 244/151 R
2,817,393 A * 12/1957 Mitchell ..... A47D 15/006 297/484
3,154,272 A * 10/1964 Gold ..... B64D 17/30 244/151 R
3,448,826 A * 6/1969 Rosenblum ..... A62B 35/0012 182/3
3,559,932 A * 2/1971 Ternes ..... B64D 17/30 244/151 R
3,954,280 A * 5/1976 Roberts ..... B60R 22/105 280/801.2
4,273,215 A * 6/1981 Leggett ..... A62B 35/0068 119/857
4,378,921 A * 4/1983 Allen ..... B64D 17/30 182/6

(Continued)

FOREIGN PATENT DOCUMENTS

FR 2.087.763 A5 12/1971
FR 2 427 828 A1 1/1980
FR 2 446 117 A1 8/1980

*Primary Examiner* — Katherine W Mitchell
*Assistant Examiner* — Shiref M Mekhaeil
(74) *Attorney, Agent, or Firm* — Oliff PLC

(57) ABSTRACT

The full body climbing harness comprises:
- a pair of leg loops,
- a belt,
- a pair of shoulder straps comprising first and second shoulder straps,
- a hasp connected to the pair of leg loops,
- a first strap connecting the belt, the pair of shoulder straps, and the hasp,
- a first adjustment device configured to adjust the length of the first strap,
- a first deflecting element juxtaposed with the hasp and passed through by the first strap so that:
  - the first strap forms at least a part of the belt and at least a part of the first shoulder strap,
  - the first adjustment device is configured to adjust both the circumference of the belt and the length of the first shoulder strap.

19 Claims, 5 Drawing Sheets

(56) References Cited

U.S. PATENT DOCUMENTS 4,553,633 A * 11/1985 Armstrong ..... A62B 35/0037 119/857
5,080,191 A * 1/1992 Sanchez ..... A47D 13/086 182/3
5,203,829 A * 4/1993 Fisk ..... A62B 35/0018 119/857
5,228,412 A * 7/1993 Bell ..... A62B 35/0025 182/3
5,329,884 A * 7/1994 Bell ..... A62B 35/0018 119/857
5,348,035 A * 9/1994 Porter ..... A61H 3/02 135/66
5,360,082 A * 11/1994 Bell ..... A62B 1/06 182/3
5,433,289 A * 7/1995 O'Rourke ..... A62B 35/0018 182/3
5,531,292 A * 7/1996 Bell ..... A62B 35/0018 182/3
5,988,315 A * 11/1999 Crane ..... A45F 5/00 182/3
6,405,685 B1 * 6/2002 Cox ..... A62B 35/0018 119/857
6,467,851 B1 * 10/2002 Mannell ..... A47D 13/086 119/770
6,691,824 B2 * 2/2004 Sharp ..... A62B 35/04 182/18
6,804,830 B2 * 10/2004 Reynolds ..... A62B 35/0018 182/3
7,063,185 B2 * 6/2006 Green ..... A01M 31/02 182/187
D556,383 S * 11/2007 Petzl ..... D29/101.1
8,469,147 B2 * 6/2013 Myers ..... A44B 11/04 182/3
D805,254 S * 12/2017 Lopez ..... D29/101.1
10,010,729 B1 * 7/2018 Murphy ..... A62B 35/0018
10,035,029 B2 * 7/2018 Dawson ..... A62B 35/0012
2003/0172431 A1 * 9/2003 Allen ..... A41D 13/0007 2/69
2004/0065272 A1 * 4/2004 Reynolds ..... A62B 35/0018 119/770
2005/0067221 A1 * 3/2005 Wolner ..... A62B 35/0031 182/3
2005/0087146 A1 * 4/2005 Reardon ..... A47D 13/086 119/770
2005/0194211 A1 * 9/2005 O'Shall ..... A62B 35/0025 182/3
2005/0263347 A1 * 12/2005 Hill ..... A62B 35/0018 182/3
2006/0169534 A1 * 8/2006 Green ..... A01M 31/02 182/7
2007/0272484 A1 * 11/2007 Helms ..... A62B 35/0018 182/3
2008/0136246 A1 * 6/2008 Salter ..... A47D 13/086 297/485
2008/0256680 A1 * 10/2008 Peksoz ..... A41D 13/0007 2/93
2009/0200106 A1 * 8/2009 McKay ..... A62B 35/0006 182/3
2009/0314578 A1 * 12/2009 Hede ..... A62B 35/0012 182/3
2011/0017546 A1 * 1/2011 Nichols, Jr. ..... A62B 35/0018 182/3
2012/0324706 A1 * 12/2012 Yocco ..... A62B 35/0018 29/525.01
2013/0056302 A1 * 3/2013 Bishop ..... A62B 35/0025 182/3
2014/0060969 A1 * 3/2014 Seman ..... A62B 35/0025 182/3
2014/0353080 A1 * 12/2014 Chevalier ..... A62B 35/00 182/3
2016/0296770 A1 * 10/2016 Kennedy ..... A62B 1/14
2016/0332010 A1 * 11/2016 Lowell ..... A62B 35/0018
2016/0360838 A1 * 12/2016 Casebolt ..... A44B 11/2592
2017/0216635 A1 * 8/2017 Stibilj ..... A62B 35/0018
2017/0326389 A1 * 11/2017 Vergara ..... A62B 35/0018
2018/0126195 A1 * 5/2018 Lopez ..... A62B 35/0025
2018/0161607 A1 * 6/2018 Jacob ..... A62B 35/0025
2018/0345053 A1 * 12/2018 Bouquier ..... A62B 35/0006

* cited by examiner

FULL BODY CLIMBING HARNESS

FIELD OF THE INVENTION

The invention relates to a full body climbing harness, in particular to a full body climbing harness that is quickly and easily adjustable.

STATE OF THE ART

In the scope of use for sports activities, full body harnesses are mainly used by children. A child does in fact have a different centre of gravity from that of an adult—the smaller he or she is, the higher his/her centre of gravity. It is therefore important that a child's harness attachment hasp be positioned relatively high up on his/her chest, close the sternum, and that the harness be provided with a pair of shoulder straps so that the top of the child's body does not topple over backwards in the event of a fall.

Full body harnesses designed for children who want to go rock climbing with a sports club or on an individual basis therefore exist on the market.

For example, the full body harness marketed by the Edelrid Company under the name of Fraggle comprises a pair of shoulder straps and a pair of leg loops. The harness closes by means of a clip fixed to the shoulder straps, and the child can then make his belay knot by means of two semi-hasps placed on the belt on each side of the clip. The pair of leg loops is connected to the two semi-hasps by means of straps of fixed lengths. The pair of shoulder straps for its part comprises two adjustable straps connected to the belt. The adjustment means of the webbing straps of the pair of shoulder straps enables the top of the harness to be adjusted to the corpulence of the child, which has the effect of adjusting the hasp vertically on the child's torso.

The full body harness marketed by the Simond Company under the name of Spider Kid presents a fairly similar construction. Here, two straps are crossed over one another on the torso and on the back so as to form a pair of shoulder straps. The straps are sewn to the pair of leg loops to close the harness. The hasp is a strap sewn onto the ventral crossing of the webbing forming the shoulder straps. Adjustment loops of the straps are positioned at the level of the torso above the hasp and enable the pair of shoulder straps to be adjusted to the size of the child. A dorsal strap acts as belt. The latter is sewn onto the dorsal part of the straps forming the pair of shoulder straps.

The drawback of these harnesses is that the circumference of the belt is not adjustable, which means that a slender child is not correctly secured in the event of a fall. In the worst case, if the child topples over on himself, he may even slide out of the harness through the space situated between the belt and the pair of leg loops. This type of harness does not provide optimum protection if it is not correctly adjusted to suit the size and corpulence of the child.

It is also known to fabricate harnesses made by means of a single strap that forms the shoulder straps, the belt and the leg loops. These harnesses are adjustable, but they are not practical to use because the excess length of strap must flow between the different components of the harness until it reaches the adjustment device. For example, an excess length strap at the belt should be transferred to the shoulder straps and then to the adjustment device.

OBJECT OF THE INVENTION

One object of the invention is to remedy these shortcomings by proposing a full body harness providing an enhanced safety and that is easy to adjust.

For this purpose, the harness comprises:

- a pair of leg loops,
- a belt,
- a pair of shoulder straps comprising first and second shoulder straps,
- an attachment hasp connected to the pair of leg loops,
- a first strap connecting the belt with the pair of shoulder straps,
- a first adjustment device configured to adjust the length of the first strap.

The harness is remarkable in that the hasp comprises a first deflecting element through which the first strap passes so that:

- the first strap forms at least a part of the belt and at least a part of the pair of shoulder straps,
- the first adjustment device is configured to adjust both the circumference of the belt and the length of the first shoulder strap.

In one development, the first strap forms at least a part of the first shoulder strap. A second strap connects the belt with the second shoulder strap. A second adjustment device is configured to adjust the length of the second strap. A second deflecting element is formed in the attachment hasp and is passed through by the second strap so that:

- the second strap forms at least a part of the belt and at least a part of the second shoulder strap,
- the second adjustment device is configured to adjust both the circumference of the belt and the length of the second shoulder strap.

In a preferential embodiment, the first strap and second strap belong to one and the same strap.

Advantageously, the strap forming the first strap and second strap extends from the first deflecting element to the second deflecting element.

It is advantageous to provide for the second deflecting element to be positioned in symmetrical manner to the first deflecting element with respect to a sagittal plane of the harness.

In preferential manner, the first adjustment device is fixed to the first shoulder strap. As an alternative, the first adjustment device is fixed to the belt.

It is also possible to provide for the second adjustment device to be fixed to the second shoulder strap. As an alternative, the second adjustment device is fixed to the belt.

In another embodiment, the first and second shoulder straps are fixed to one another to form a dorsal part of the pair of shoulder straps and an additional strap connects a lumbar area of the belt to the dorsal part of the pair of shoulder straps.

In another development, the additional strap collaborates with an additional adjustment device configured to adjust the distance separating the dorsal part of the pair of shoulder straps and the lumbar area of the belt.

Preferentially, the additional adjustment device is fixed to the lumbar area of the belt. As an alternative, the additional adjustment device is fixed to the dorsal part forming the junction with the first and second shoulder straps.

In a preferential embodiment, the hasp comprises a transverse strap, the first deflecting element and second deflecting element being respectively fixed to opposite first and second ends of the transverse strap.

It is also possible to provide for the first deflecting element, the second deflecting element and a suspension point of the hasp to be formed by a metal plate or ring.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figures 1A, 1B:
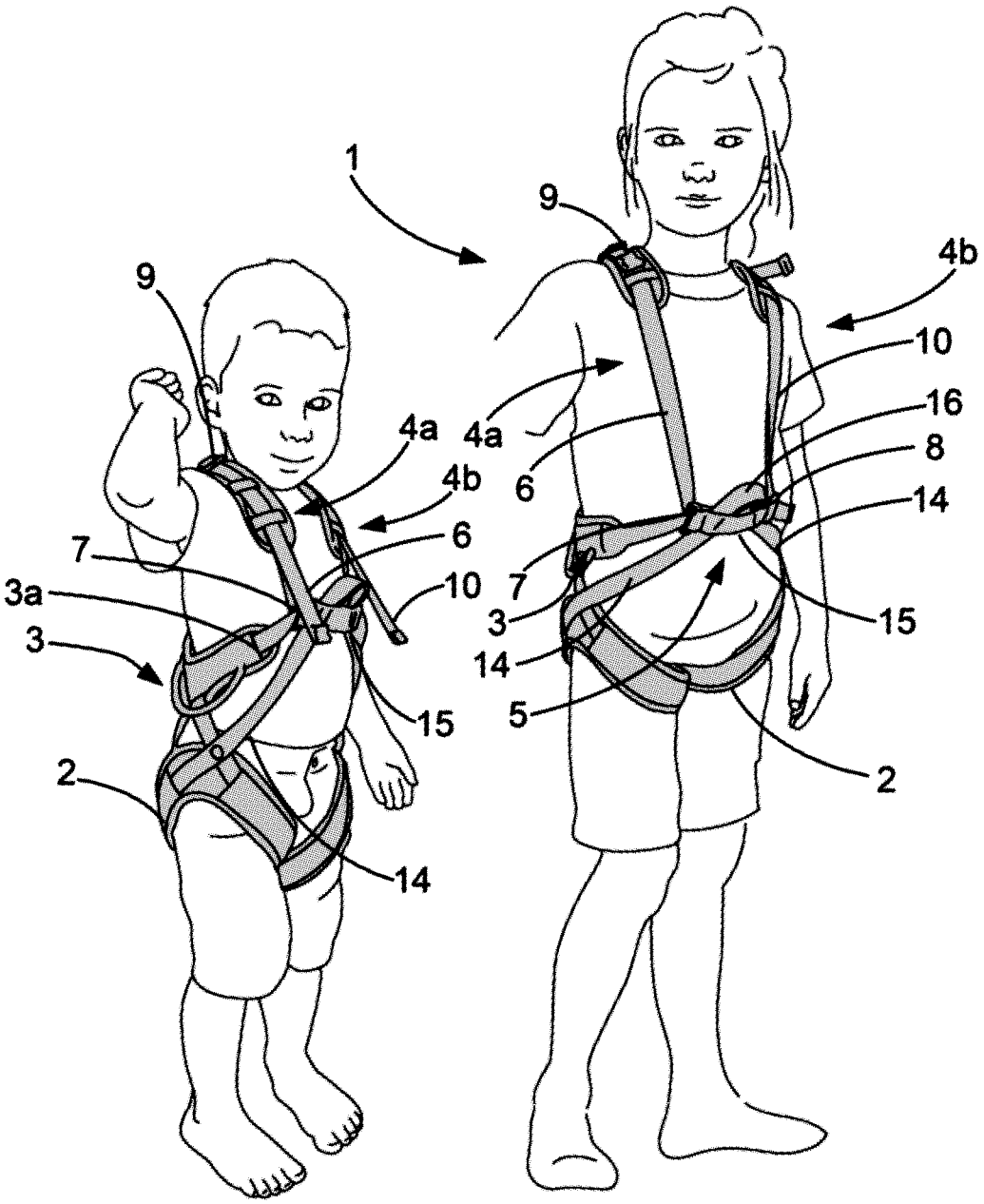
FIGS. 1A and 1B illustrate, in schematic manner, an embodiment of a full body climbing harness in three-quarter view.

FIGS. 1A-2B represent two children of different sizes wearing the same full body climbing harness 1. The latter comprises a pair of leg loops 2, a belt 3 and a pair of shoulder straps 4, each of these components advantageously comprising a padded support strip in order to guarantee the child's comfort. The support strip of the belt 3 can comprise gear slings.

The harness 1 is also provided with a hasp 5 which closes the belt 3. The hasp 5 is connected to the pair of leg loops 2 and to the pair of shoulder straps 4. The pair of shoulder straps comprises a first shoulder strap 4*a* and a second shoulder strap 4*b*. The two shoulder straps pass respectively over each of the user's shoulders. In conventional manner, the shoulder straps 4*a* and 4*b* are connected to the lumbar part of the belt 3.

Connection of the hasp 5 with the pair of shoulder straps 4 is performed by means of at least a first strap 6. In the illustrated embodiment, the pair of shoulder straps is connected to the hasp 5 by a first strap 6 and by a second strap 10. In more particular manner, the first shoulder strap 4*a* is connected to the hasp 5 by means of the first strap 6 and the second shoulder strap 4*b* is connected to the hasp 5 by means of a second strap 10.

In the illustrated embodiment, the pair of shoulder straps 4 comprise a dorsal part 4*c* forming a junction between the first shoulder strap 4*a* and second shoulder strap 4*b*. In this way, the pair of shoulder straps 4 can have a single contact point with the belt 3 at the rear. As an alternative, the two shoulder straps 4*a* and 4*b* could be connected independently or together to the belt 3 behind the user's back. It is advantageous to connect the shoulder straps in the support strip of the belt.

Such a junction of the shoulder straps 4*a* and 4*b* may be used to connect the two shoulder straps 4*a*/4*b* with the hasp 5 by means of a single strap.

In order to adjust the dimensions of the harness 1 to the user's corpulence, i.e. the height of the chest and the circumference of the hips, it is advantageous to provide adjustment means of these two dimensions. As indicated in the foregoing, only one of these two dimensions is adjusted in the harness of the prior art, with the risk of not correctly adjusting the harness to fit the user's dimensions.

In order to facilitate adjustment of the harness 1, the inventors propose to use the first strap 6 to form at least a part of the pair of shoulder straps and to form at least a part of the belt 3. The inventors propose to simultaneously adjust the length of the pair of shoulder straps 4*a*/4*b* or of at least one of the shoulder straps and the circumference of the belt 3 by adjusting the length of the first strap 6.

To achieve this, the hasp 5 comprises a first deflecting element 7 arranged to perform an angular deviation of the first strap 6 between the belt 3 and at least one of the shoulder straps. The first strap 6 passes through the first deflecting element 7 so as to advantageously form at least a part of the pair of shoulder straps 4*a*/4*b* and at least a part of the belt 3. The first strap 6 connects the pair of shoulder straps with the belt by passing through the first deflecting element 7. The strap portion that forms a part of the pair of shoulder straps passes through the deflecting element to be deflected and form immediately after at least part of the belt. The first deflecting element 7 is a slip deflecting element so that by pulling on one end of the first strap, it is possible to adjust the shoulder strap and the belt simultaneously by applying the same stress to the user. The first deflecting element makes the separation between the strap portion forming the belt and the strap portion forming the shoulder strap.

In order to adjust the length of the first strap 6 to adjust the circumference of the belt 3 and the length of the pair of shoulder straps 4 or of at least one of the shoulder straps to the size and corpulence of the user, the harness 1 comprises a first adjustment device 9 connected to the first strap 6 and configured to adjust the effective length of the first strap 6.

The first adjustment device 9 can be fitted at different locations on the harness. The first adjustment device can be fixed either to one of the shoulder straps, for example to the first shoulder strap 4*a* or to the second shoulder strap 4*b*, or to the belt 3. The first adjustment device 9 enables the effective length of the first strap 6 to be shortened or lengthened. The first adjustment device 9 enables the effective length of the first strap 6 to be blocked.

In the embodiment illustrated in FIGS. 1A and 1B, the first shoulder strap 4*a* is connected to the hasp 5 by the first strap 6 and the second shoulder strap 4*b* is connected to the hasp 5 by a second strap 10, so that the two shoulder straps are distinct from one another at least from the user's shoulders down to the hasp 5.

In a particular embodiment illustrated in FIGS. 1A and 1B, the first strap 6 collaborates with the first deflecting element 7 and first adjustment device 9 to adjust the length of the first shoulder strap 4*a* and the circumference of the belt 3. In advantageous manner, the first strap 6 passes through the first deflecting element 7 of the hasp 5.

The second strap 10 collaborates with a second deflecting element 8 and a second adjustment device 11 to adjust the length of the first shoulder strap 4*b* and the circumference of the belt 3. The second deflecting element 8 is distinct from the first deflecting element 7. In advantageous manner, the shape of the second deflecting element is identical to that of the first deflecting element 7, but its orientation can be different in order to achieve a symmetry in the structure of the harness. The hasp 5 advantageously comprises the second deflecting element 8. In advantageous manner, the second strap 10 passes through the second deflecting element 8.

In a preferential embodiment, the first deflecting element 7 and second deflecting element 8 are arranged at two opposite ends of the hasp 5 and advantageously along the longitudinal axis of the belt in order to facilitate take-up of stresses and to prevent the formation of hang-up points generating discomfort. Preferably, the first and second deflecting elements 7 and 8 are positioned in symmetrical manner with respect to a sagittal plane Ps of the harness 1 or of the user who is also a plane of symmetry of the hasp 5.

In this configuration, each shoulder strap 4*a*/4*b* can be adjusted separately. The circumference of the belt is defined by the two straps 6 and 10. This embodiment is particularly advantageous as it makes adjustment of the harness 1 easier and enables the hasp to be better positioned on the sagittal plane of the user.

Although the two straps 6 and 10 can be adjusted separately to define the length of the shoulder straps 4*a* and 4*b*, it is possible to provide for the straps 6 and 10 to belong to a single strap, for example they represent the two opposite ends of one and the same strap. It is also possible for the two straps 6 and 10 to be different and physically dissociated from one another.

It is particularly advantageous to provide for the straps 6 and 10 to belong to one and the same strap which facilitates manufacturing of the harness and take-up of stresses.

In the configurations presented, the first strap 6 forms at least a part of the first shoulder strap 4*a* and at least a first part of the belt 3. The second strap 10 forms at least a part of the second shoulder strap 4*b* and at least a second part of the belt 3. These first and second parts of the belt are in direct contact with the hasp via the first and second deflecting elements 7 and 8.

It is possible to provide for the first strap 6 and second strap 10 to form the whole of the belt 3. The same strap advantageously passes right round the user, passing for example inside the belt support 3*d* illustrated in FIGS. 1A-2B.

As an alternative, the two straps may only form a part of the belt. The rest of the belt can be formed by another strap or by a reinforcement part of the support illustrated in FIGS. 1A-2B.

In advantageous manner, the support of the belt 3 comprises a guide which allows passage of the first strap 6 inside the support in order to protect the latter against external aggressions. The support of the belt 3 can also define a guide which allows passage of the second strap 10 inside the support. The guide can run along the whole length of the support in order to enable a single strap to form the belt 3.

If the first and second straps 6 and 10 are formed by the same strap, it is advantageous to provide for the strap to be fixed to the belt support 3*d*, for example by a stitched seam. In this way, the portions of the strap which form straps 6 and 10 are fixed with respect to the support which defines the optimal position of use. This prevents an offset of the strap from progressively occurring with use of the harness.

Figure 4:
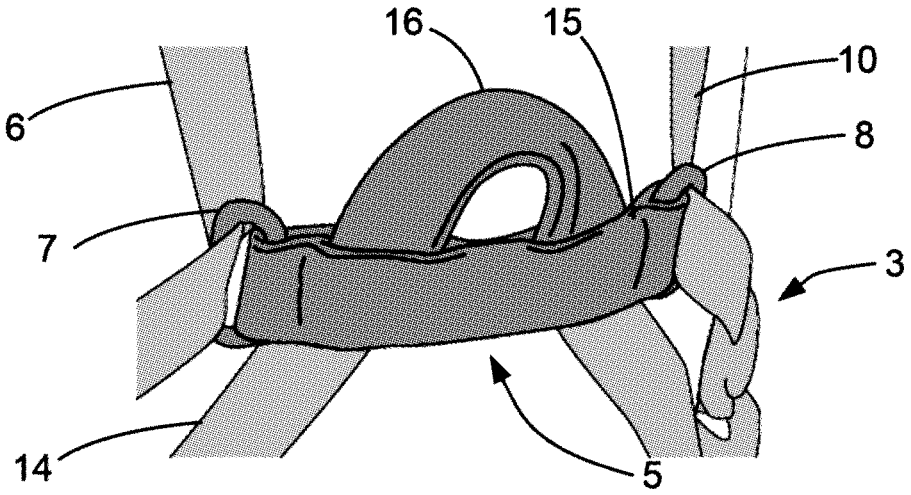
Figure 6:
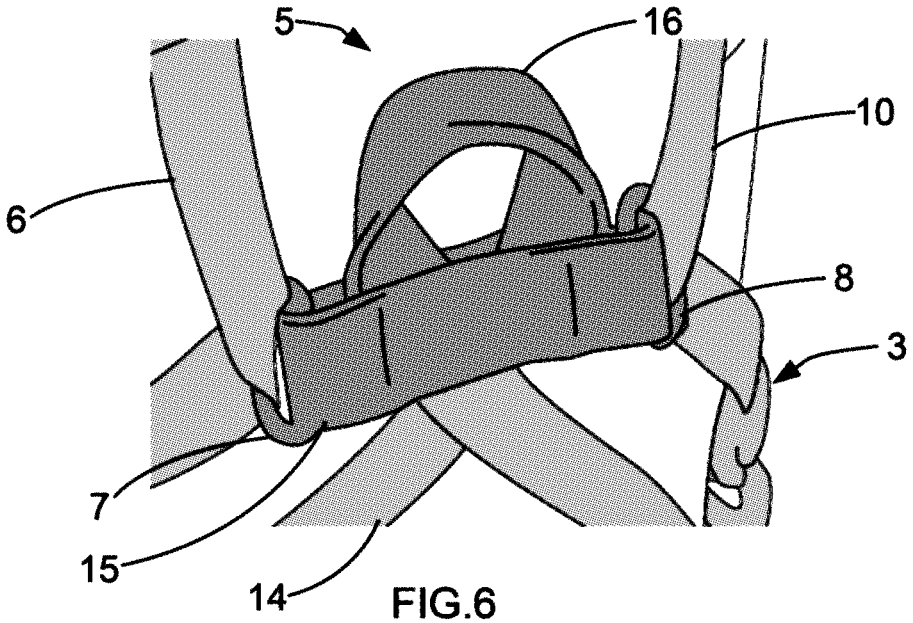

As illustrated in FIGS. 4 and 6, the first strap 6 can pass through the first deflecting element 7 and the second strap 8 can pass through the second deflecting element 8, entering these deflecting elements from the side placed against the child's body and exiting towards the outside. The first strap 6 can indifferently enter the first and second deflecting elements 7 and 8 from the outside and exit from the side where the child's body is situated. In arbitrary manner, a strap enters from the belt 3 and exits in the direction of a shoulder strap 4*a*/4*b*.

In an alternative embodiment, the first strap 6 forms the whole of the first shoulder strap 4*a*, i.e. it connects the hasp with a lumbar part of the belt 3. It is also possible to provide for the second strap 10 to form the whole of the second shoulder strap 4*b*.

In a particular embodiment illustrated in FIGS. 1A and 1B, the first strap 6 and second strap 10 only form a part of the first and second shoulder straps 4*a* and 4*b*. The two shoulder straps are joined to one another at a fixing point which is used to connect the dorsal part of the shoulder straps with the lumbar part of the belt 3.

To further improve adjustment of the full body climbing harness 1, the latter can be provided with an additional adjustment device 12 which is configured to adjust the height of the harness at dorsal level, i.e. the distance between the belt 3 and the pair of shoulder straps 4 on the child's back. For this purpose, the additional adjustment device 12 collaborates with an additional strap 13 which connects a lumbar area 3*c* of the belt 3 to the dorsal part 4*c* of the pair of shoulder straps 4.

This embodiment is particularly advantageous when the two shoulder straps 4*a* and 4*b* are joined to one another behind the user's back in order to prevent the tension applied on the first strap 6 or on the two straps 6 and 10 from being applied on the cervical vertebrae. The additional adjustment device 12 is configured to define the distance which separates the dorsal part of the belt and the junction of the two shoulder straps 4*a* and 4*b*.

Figure 2A:
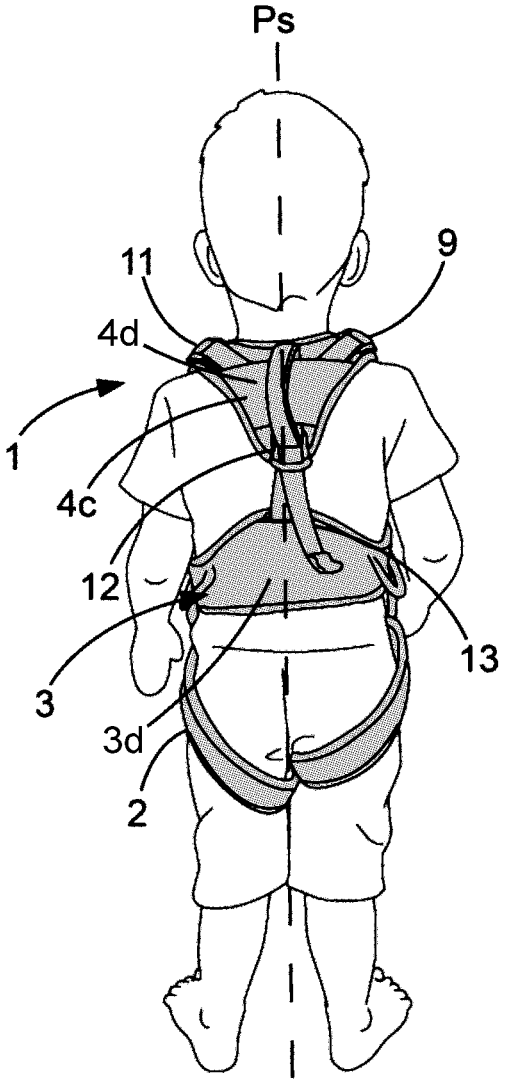
FIGS. 2A and 2B represent a rear view of the full body climbing harness according to the embodiment illustrated in FIGS. 1A and 1B, FIGS. 3 and 4 illustrate the details of the hasp according to the embodiment presented in FIGS. 1A-2B, FIGS. 5 and 6 present an alternative embodiment of the full body climbing harness.
Figure 2B:
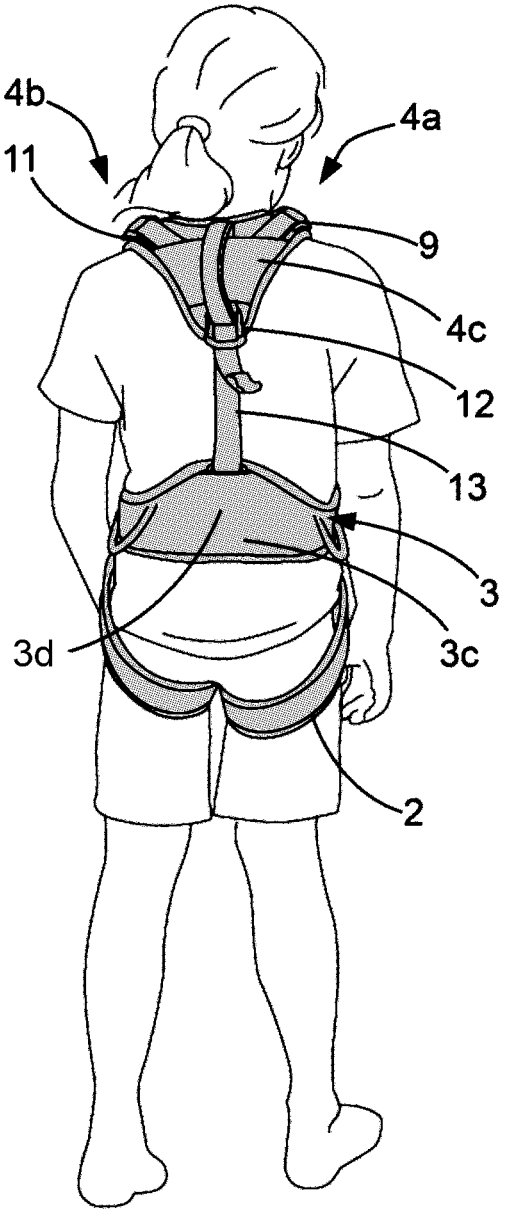
Figure 3:
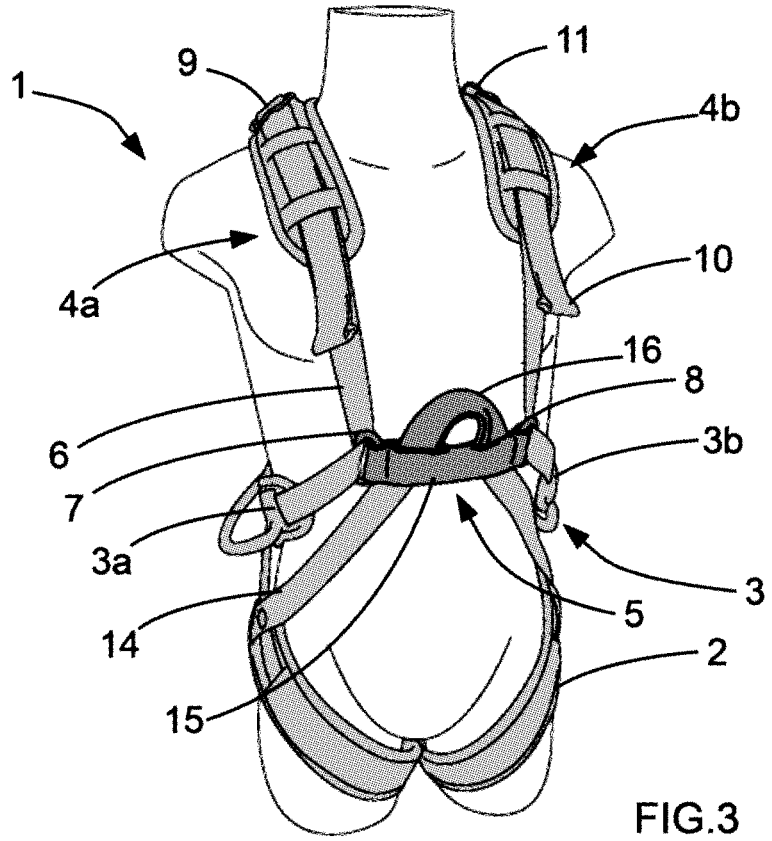

According to the embodiment illustrated in FIGS. 2A and 2B, the additional adjustment device 12 can be fixed on the dorsal part 4*c* of the first and second shoulder straps 4*a* and 4*b*, i.e. where the latter join one another. In this case, the additional strap 13 is advantageously fixed to the lumbar area 3*c* of the belt 3 and passes through the additional adjustment device 12. As an alternative, the strap 13 can be fixed to the dorsal part 4*c* and form a loop the size of which is adjusted. The first and second shoulder straps 4*a* and 4*b* are joined to one another to form the dorsal part 4*c* of the first and second shoulder straps 4*a* and 4*b*, and a shoulder support 4*d* is directly fixed to the dorsal part 4*c*, and the additional strap 13 connects the lumbar area 3*c* of a belt support 3*d* of the belt 3*d* to the shoulder support 4*d*. In addition, a second adjustment device 11 is fixed to the shoulder support 4*d*.

Therefore, to adjust the height of the harness 1, the person who is supervising the child simply has to pull the additional strap 13 downwards. The harness 1 is correctly adjusted when the belt 3 presses on the child's iliac crests, and when there is no clearance between the child's shoulders and the pair of shoulder straps 4.

As an alternative, the additional adjustment device 12 can be fixed to the lumbar area 3*c* of the belt 3. The additional strap 13 is then advantageously fixed to the dorsal part 4*c* of the pair of shoulder straps 4 and slides in the additional adjustment device 12. The additional strap 13 then simply has to be pulled upwards to position the belt 3 correctly with respect to the pair of shoulder straps 4, the belt 3 having to be situated on the child's iliac crests. There again, the additional strap 13 can form a loop having a length which is adjusted to adjust the distance separating the dorsal part 4*c* of the shoulder straps and the lumbar area 3*c* of the belt 3.

The combined use of the first adjustment device 9, possibly in combination with the second adjustment device 11 and/or with the additional adjustment device 12, enables an optimum adjustment of the full body climbing harness 1 to be obtained. The latter adjusts perfectly to the size and corpulence of child who is therefore secured in comfortable manner and in total safety.

Several embodiments can be envisaged to form the hasp 5. In a particular embodiment, the hasp 5 comprises a transverse strap 15. The first and second deflecting elements 7 and 8 are located at the two opposite ends of the transverse strap 15. The hasp 5 comprises a suspension loop 16 which can be made from a textile or a metallic element.

According to a first embodiment illustrated in FIGS. 1A to 4, the suspension loop 16 can be formed from a connecting strap 14 which connects the hasp 5 to the pair of leg loops 2. The connecting strap 14 connects the leg loops 2 to a first surface of the transverse strap 15 and passes through the transverse strap 15 so as to form a loop on the surface opposite the surface connected to the leg loops 2.

To form the suspension loop or ring 16, the connecting strap 14 can be folded so as to form a U shape, and a transverse strap 15 can be sewn onto the connecting strap 14 so that the assembly forms the hasp 5. The two ends of the transverse strap 15 can advantageously comprise metal loops forming the first and second deflecting elements 7 and 8, or acting as attachment area for metal deflecting elements 7 and 8 such as rings. The first and second deflecting elements 7 and 8 are advantageously positioned in symmetrical manner with respect to the latter and to the sagittal plane Ps.

Figure 5:
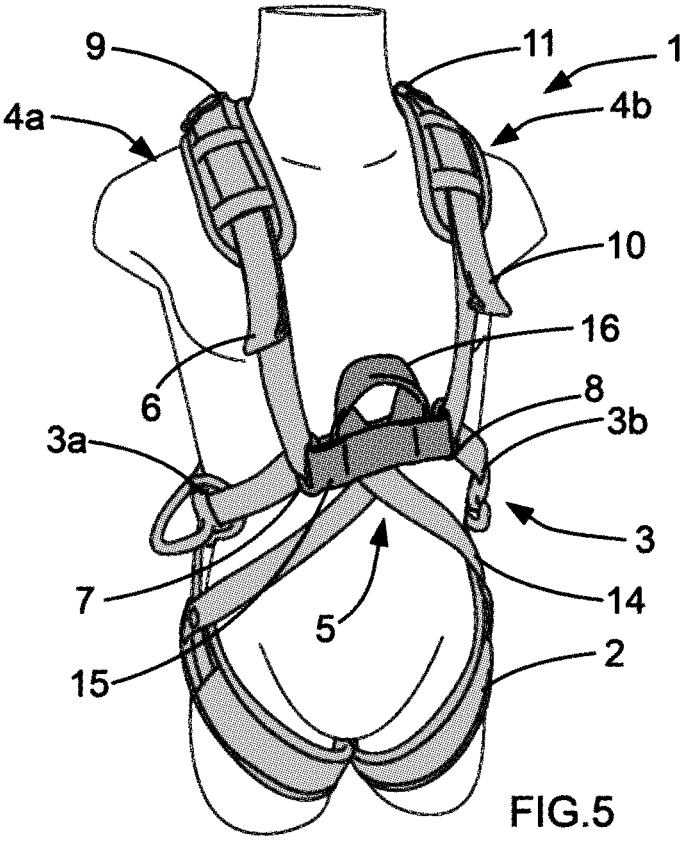

In an alternative embodiment presented in FIGS. 5 and 6, the ends of the connecting strap 14 can be crossed over one another so as to form a loop, and the transverse strap 15 can be stitched in the area where the two strands of the connecting strap 14 are superposed. As in the previous embodiment, the transverse strap 15 can advantageously comprise two loops at each of its ends, the two loops corresponding either to the first and second deflecting elements 7 and 8 (case which is not represented) or to attachment areas of the deflecting elements 7 and 8 (embodiment of FIGS. 5 and 6). The first and second deflecting elements 7 and 8 are advantageously placed in symmetrical manner with respect to the hasp 5 and to the sagittal plane Ps so as to enable an identical adjustment of the two shoulder straps and to guarantee user comfort.

According to another alternative embodiment, the hasp 5 with its suspension loop 16, the first deflecting element 7, and second deflecting element 8 can be formed in a single part such as a ring (embodiment not represented). The ring can be either a metal ring or a webbing ring. In this case, the first strap 6 and the second strap 10 (if the latter exists) pass through the ring. The same is the case for the connecting strap 14 which connects the hasp 5 to the pair of leg loops 2. The child also uses the ring to make his belay knot when he is climbing.

Figure 7:
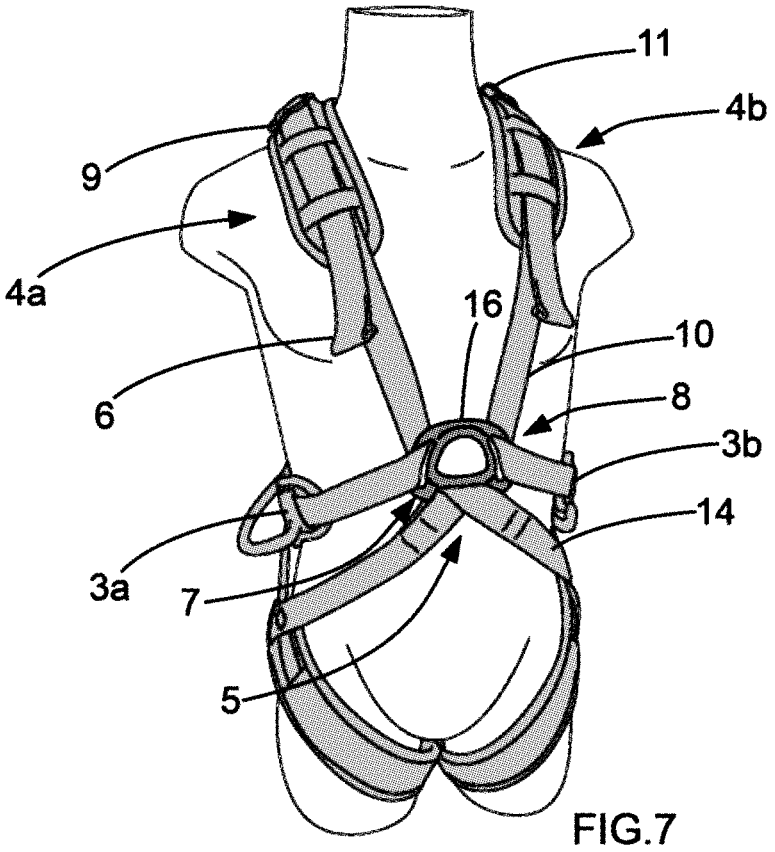
FIGS. 7 and 8 present another alternative embodiment of the full body climbing harness.
Figure 8:
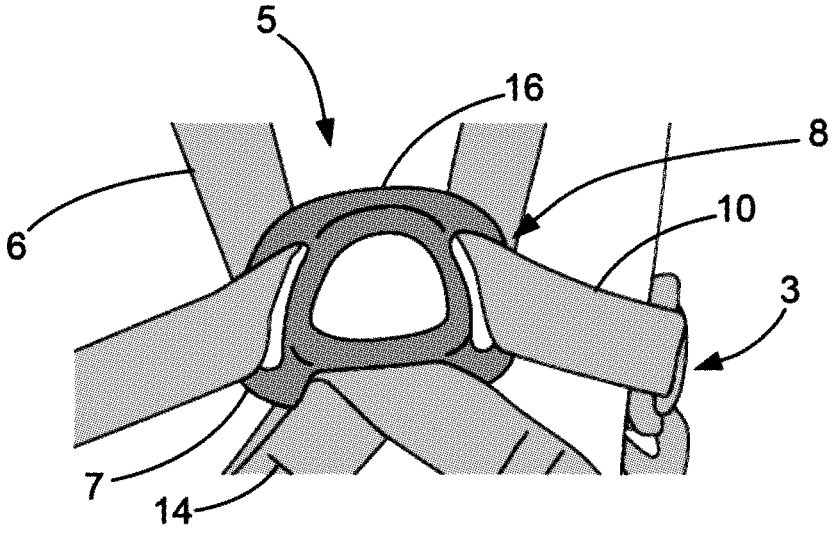

Instead of the ring, a metal plate, also called metal connector, can be used. This embodiment is the one illustrated in FIGS. 7 and 8. The plate can advantageously comprise four pass-through holes, three of which are substantially oblong in order to allow the first and second straps 6 and 10 and the connecting strap 14 to pass through. The fourth hole, which is central, forms the hasp 5 and enables the user to perform his belaying actions. This embodiment is preferred as it enables the straps performing adjustment of the harness to be better dissociated from the other parts which may be connected to the suspension ring.

The present invention is not limited to the features which have been mentioned in the above. Without departing from the scope of the invention, additional deflecting elements can be provided in order to complexify the path of the straps if necessary between the pair of shoulder straps 4 and the belt 3. It is also possible to eliminate the padded support strips of the pair of shoulder straps 4, of the belt 3 and of the pair of leg loops 2, as these strips do not play any role in the child's safety but simply contribute to his comfort.

Whatever the embodiment chosen, the full body climbing harness 1 is very easy to adjust to the child's size and corpulence. Being able to adjust both the length of the shoulder straps 4 and the circumference of the belt 3, and if need be the dorsal height of the harness 1, means that optimum adjustment can be achieved. The child's safety is therefore enhanced compared with harnesses of the prior art.

As indicated in the foregoing, it is possible to provide for the same strap to form the first and second straps 6 and 10. As indicated in the foregoing, adjustment of the harness is preferentially performed by means of the first adjustment device and by means of the second adjustment device.

The two adjustment devices can be arranged on the shoulder straps 4*a* and 4*b* or on the belt 3. It is also possible to combine an adjustment device on a shoulder strap 4*a*/4*b* and an adjustment device on the belt 3.

The use of a single strap also makes it possible to only use the first adjustment device. It is then advantageous to provide sliding of the strap in the belt support if the belt support is used. It is also advantageous to provide for the strap to be able to run between the shoulder straps.

In the embodiment illustrated in FIGS. 2A and 2B, the dorsal part 4*c* of the pair of shoulder straps 4 can act as support for a third deflecting element (not shown) positioned at the level of the shoulder blades or of the bottom cervical vertebrae.

To adjust the full body climbing harness 1 on the user's body, it is advantageous to slacken the first strap 6 and possibly the second strap 10 to the maximum, to position the harness 1 on the user. The first strap 6 is retightened so as to apply the same tension on the two ends 3*a* and 3*b* of the belt 3 and on the shoulder straps 4*a* and 4*b*. This enables the hasp 5 to be naturally placed in the right position corresponding to the child's centre of gravity.

When the two shoulder straps are joined by a dorsal shoulder strap support, it is advantageous to adjust the shoulder strap support so that the first strap 6 and possibly the second strap 10 are taut.

In the embodiment illustrated in FIGS. 1A and 1B, the belt 3 comprises a belt support 3*d* which has a first end 3*a* and an opposite second end 3*b*.

In advantageous manner, the first strap 6 can connect the first end 3*a* of the support of the belt 3 to the first end of the shoulder strap support and a second strap 10 can be used to connect the second end 3*b* of the support of the belt 3 to the second end of the shoulder strap support.

In this configuration, application of a tension on the first and second straps 6 and 10 enables the belt 3 and first and second shoulder straps 4*a* and 4*b* to snugly fit the user's morphology.

For the sake of simplicity of manufacturing and of adjustment on the child's body, the first and second adjustment devices 9 and 11 can advantageously be arranged in symmetrical manner with respect to the sagittal plane Ps.

For example, according to the embodiment illustrated in FIGS. 1A and 1B, the first and second adjustment devices 9 and 11 can be fixed to the shoulder strap support.

Depending on the manner in which the first and second adjustment devices 9 and 11 are fitted on the pair of shoulder straps 4, the child (or the adult who is supervising him) simply has to pull downwards or upwards on the ends of the first and second straps 6 and 10 to adjust both the size of the pair of shoulder straps 4 and the circumference of the belt 3. It is preferable to exert an identical tensile force on each strap in order to obtain identical tightening for the two shoulder straps 4*a* and 4*b*, and so that the hasp 5 is positioned towards the front of the child's torso and bisects the sagittal plane Ps.

It is preferable to exert an identical tensile force on each strap in order to obtain identical tightening for the two shoulder straps 4*a* and 4*b*, and so that the hasp 5 is positioned towards the front of the child's torso and bisects the sagittal plane Ps.

In the illustrated embodiments, the first strap 4 and the second strap 6 do not participate in the adjustment of the leg loops. Thus, the adjustment of the belt and shoulder straps can be independent of the adjustment of the leg loops, making it easier to realize the harness and easier to adjust the harness to the user's morphology. For example, the hasp is attached to the leg loops by means of an additional strap which is different from the first strap and the second strap.

The invention claimed is:

1. A full body climbing harness comprising:

a pair of leg loops, a hasp connected to the pair of leg loops by means of a connecting strap, the hasp defining a first deflecting element and defining a pass-through hole forming a ventral suspension point, a first strap passing through the first deflecting element and forming at least a part of a belt and at least a part of a first shoulder strap, the first strap sliding in the first deflecting element, the first strap being distinct from the connecting strap, the first strap extending along a longitudinal direction and the first deflecting element deflecting the longitudinal direction of a part of the first strap forming part of the first shoulder strap from a substantially vertical direction to a substantially horizontal direction for forming the part of the belt, and a first adjustment device configured to adjust and block an effective length of the first strap and to adjust simultaneously a circumference of the belt and a length of the first shoulder strap, wherein the belt is a waist belt and the first shoulder strap extends in a direction that is substantially perpendicular to a direction in which the waist belt extends, and wherein the first strap does not form the pair of leg loops.

2. The full body climbing harness according to claim 1, wherein:

the hasp defines a second deflecting element, a second strap passes though the second deflecting element, the second strap forming at least a part of the belt and at least a part of a second shoulder strap, the second strap sliding in the second deflecting element, the second strap being different from the connecting strap, and a second adjustment device is configured to adjust and block an effective length of the second strap, the second adjustment device adjusting simultaneously both the circumference of the belt and the length of the second shoulder strap.

3. The full body climbing harness according to claim 2, wherein one and the same strap forms the first strap and the second strap, the one and the same strap forming the first strap and the second strap being different from the connecting strap connecting the hasp to the pair of leg loops.

4. The full body climbing harness according to claim 3, wherein the one and the same strap forming the first strap and second strap extends from the first deflecting element to the second deflecting element.

5. The full body climbing harness according to claim 2, wherein the second deflecting element is positioned in symmetrical manner to the first deflecting element with respect to a sagittal plane of a user.

6. The full body climbing harness according to claim 2, wherein the first and second shoulder straps are joined to one another to form a dorsal part of the first and second shoulder straps, a shoulder support is directly fixed to the dorsal part, and an additional strap connects a lumbar area of a belt support of the belt to the shoulder support, and wherein the second adjustment device is fixed to the shoulder support.

7. The full body climbing harness according to claim 2, wherein the second adjustment device is fixed to a belt support of the belt.

8. The full body climbing harness according to claim 2, wherein the hasp comprises a transverse strap, the first deflecting element and second deflecting element being respectively fixed to opposite first and second ends of the transverse strap.

9. The full body climbing harness according to claim 2, wherein the first deflecting element, the second deflecting element and a suspension point of the hasp are formed by a metal plate or ring.

10. The full body climbing harness according to claim 2 wherein the first strap, the second strap and the hasp form the waist belt integrally.

11. The full body climbing harness according to claim 1, wherein the first adjustment device is fixed to a belt support of the belt.

12. The full body climbing harness according to claim 1, wherein the first and second shoulder straps are joined to one another to form a dorsal part of the first and second shoulder straps, a shoulder support is directly fixed to the dorsal part, and an additional strap connects a lumbar area of a belt support of the belt to the shoulder support.

13. The full body climbing harness according to claim 12, wherein the first adjustment device is fixed to the shoulder support that is directly fixed to the dorsal part.

14. The full body climbing harness according to claim 12, wherein the additional strap collaborates with an additional adjustment device configured to adjust the distance separating the dorsal part of the first and second shoulder straps and the belt support by adjusting an effective length of the additional strap.

15. The full body climbing harness according to claim 14, wherein the additional adjustment device is fixed to the belt support.

16. The full body climbing harness according to claim 14, wherein the additional adjustment device is fixed to the dorsal part forming a junction between the first and second shoulder straps.

17. The full body climbing harness according to claim 1, wherein the hasp is made of textile.

18. The full body climbing harness according to claim 17, wherein the hasp holds a suspension loop made from the connecting strap, the hasp comprising a transverse strap connecting the first and second deflecting elements to the suspension loop.

19. The full body climbing harness according to claim 18, wherein the first and second deflecting elements are made of metal rings fixed at opposite ends of the transverse strap.

* * * * *